US006382007B1

(12) United States Patent
Wright

(10) Patent No.: US 6,382,007 B1
(45) Date of Patent: May 7, 2002

(54) ELECTRO-MECHANICAL SYSTEM FOR DETERMINING KEY CUTS FOR TUMBLER AND WAFER LOCKS

(76) Inventor: Jesse M. Wright, 2929 S. Locust St., Denver, CO (US) 80222

( * ) Notice: Subject to any disclaimer, the term of this patent is extended or adjusted under 35 U.S.C. 154(b) by 0 days.

(21) Appl. No.: 09/810,269

(22) Filed: Mar. 19, 2001

(51) Int. Cl.[7] ..... E05B 19/20

(52) U.S. Cl. ..... 70/394; 70/278.3; 33/540; 340/5.65

(58) Field of Search ..... 70/278.2, 278.3, 70/277, 394; 33/539, 540; 340/5.6, 5.65, 5.67

(56) References Cited

U.S. PATENT DOCUMENTS

| | | | | | |
|---|---|---|---|---|---|
| 1,695,518 | A | * | 12/1928 | Watson | 70/277 |
| 1,728,310 | A | * | 9/1929 | Sundel | 70/428 |
| 3,225,576 | A | * | 12/1965 | Richard | 70/434 |
| 3,264,742 | A | * | 8/1966 | Roland | 33/539 |
| 4,229,959 | A | * | 10/1980 | Easley | 70/394 |
| 4,535,546 | A | | 8/1985 | Smith | 33/540 |
| 4,680,870 | A | | 7/1987 | McConnell | 33/540 |
| 5,133,202 | A | * | 7/1992 | Grant | 33/540 X |
| 5,172,578 | A | | 12/1992 | Bitzios | 70/394 |
| 5,224,365 | A | | 7/1993 | Dobbs | 70/394 |
| 5,325,691 | A | | 7/1994 | Embry | 70/394 |

FOREIGN PATENT DOCUMENTS

| | | | | |
|---|---|---|---|---|
| EP | 0339102 | * | 11/1989 | 70/277 |
| JP | 404080482 A | * | 3/1992 | 70/278.2 |
| SU | 1461847 | * | 2/1989 | 70/278.2 |
| SU | 1008397 | * | 3/1993 | 70/278.2 |

* cited by examiner

*Primary Examiner*—Lloyd A. Gall
(74) *Attorney, Agent, or Firm*—Norman B. Rainer

(57) ABSTRACT

A system for decoding locks having a sequence of spring-urged sliding members such as tumbler pins or wafers includes a probe device having the general contour of a key having a head portion and a straight shank fabricated of electrically insulative material and terminating in a tip portion having an oblique ramp surface. A series of spaced apart electrical conductors embedded within the shank in parallel relationship extend from the head portion to the ramp surface where they emerge as electrical contacts. An electrical circuit which includes an electronic monitoring and display apparatus detects when a given sliding member touches a most distant electrical contact, thereby representing a travel distance. The travel distance is correlated with a particular pin or wafer to produce the key code for the lock.

10 Claims, 1 Drawing Sheet

ELECTRO-MECHANICAL SYSTEM FOR DETERMINING KEY CUTS FOR TUMBLER AND WAFER LOCKS

BACKGROUND OF THE INVENTION

1. Field of the Invention

This invention relates to the making of keys for tumbler and wafer type locks, and more particularly concerns a system for determining how to make a key to replace a lost key for a specific tumbler or wafer lock.

2. Description of the Prior Art

In cylinder locks of conventional design, a cylindrical plug having a key receiving slot or "keyway" bounded by straight upper and lower border surfaces, and having a first series of radially disposed channels communicating with said upper border surface is rotatably secured within a close fitting cylindrical bore in a housing having a second, matching series of channels, known as "pin chambers." The pin chambers are in coaxial alignment with the first series of channels, and open upon said bore. The opposite extremities of the pin chambers, furthest from the bore, are closed. Each pin chamber confines a coil spring in abutment with said closed extremity, a driver pin and a tumbler pin. In some locks the several paired driver pins and tumbler pins are matched to have equal total lengths, and some locks have equal length driver pins with varying length tumbler pins. Both the driver pin and tumbler pin of each chamber are downwardly urged by said spring in a direction transverse to the axis of the plug, whereby the tumbler pins span the gap between the plug and housing.

The lengths of the tumbler pins, and their axial location determine the "code" or key cut depths. When a properly configured key is inserted into the keyway of the plug, the tumbler pins are pushed up to a location flush with the outer surface of the plug, said location called a "shear line." When all the tumbler pins are flush with the surface of the plug, the shear line is "open," and rotation of the plug is permitted. The extent of pushed displacement of the tumbler pins to achieve an open shear line may be referred to as the "travel distance" for a given tumbler pin. The pushing action is achieved by the key acting upon the lowermost extremity of the tumbler pin, which serves as a bearing surface. If a tumbler pin crosses the shear line, the plug will not rotate.

Wafer locks, like tumbler locks, have a cylindrical key receiving plug rotatably secured within a close fitting bore in a housing. The plug holds a series of flat apertured wafers adapted to undergo sliding movement in planes transverse to the axis of elongation of the plug. An outermost edge of each wafer is adapted to enter an aligned locking groove within the bore, and the wafers are spring urged to cause such entrance into the grooves, thereby preventing rotation of the bore in the locked state of the lock.

The aperture of each wafer has an upper edge bearing surface whose distance of separation from said axis varies amongst the several wafers. A key inserted into the plug sequentially penetrates the apertures of the wafers while bearing against said upper edges. Such action causes sliding movement of the wafers against the urging of said spring interactive with each wafer. The sequential sliding movement of the wafers causes the outermost extremities of the wafers to align themselves with the surface of the plug, thereby establishing a shear line which permits rotation of the plug. The axial location of each wafer, and the radial location of the upper edge of the aperture determine the key code for a particular lock.

When a key for a specific lock is lost, it often becomes necessary to analyze the lock to ascertain the requisite code for producing a replacement key. Probe devices for determining the key cuts of locks have earlier been disclosed, as for example in U.S. Pat. Nos. 4,535,546; 4,680,870; 5,224,365; 5,325,691; and 5,172,578. Such earlier devices are based upon mechanical principles of operation, and are often limited to use on certain models of locks, unless significant change is made in the probe device. Such earlier probe devices are also usually difficult to operate or require time-consuming manipulations, and are often of considerable cost.

It is accordingly an object of the present invention to provide a system for decoding tumbler and wafer locks.

It is another object of this invention to provide a system as in the foregoing object for ascertaining key cuts, and having versatility of use in many different models of locks.

It is a further object of the present invention to provide a system of the aforesaid nature for easily and rapidly ascertaining key cuts for locks.

It is a still further object of this invention to provide a decoding system of the aforesaid nature of durable and simple construction amenable to low cost manufacture.

These objects and other objects and advantages of the invention will be apparent from the following description.

SUMMARY OF THE INVENTION

The above and other beneficial objects and advantages are accomplished in accordance with the present invention by a system for decoding tumbler locks and wafer locks having a rotatably mounted cylindrical plug having an elongated key receiving slot interactive with a series of slideable members spring urged orthogonally toward said slot and having different travel distances relative to flush fit with the surface of said plug, said flush fit establishing a shear line which permits rotation of the plug, said system comprising:

a) a probe device having the general contour of a key expected to fit within said key-receiving slot and having:
   1) a straight shank fabricated of electrically insulative material and elongated between forward and rearward extremities and bounded by opposed flat side surfaces and straight parallel upper and lower edge surfaces, and terminating in a tip portion having an oblique ramp surface extending forwardly from said upper edge surface and convergent toward said lower edge surface, said ramp surface configured to sequentially contact said slideable members,
   2) a series of spaced apart electrical conductors embedded within said shank in parallel relationship to said edge surfaces and forwardly terminating in electrical contacts in said ramp surface, and
   3) a head portion associated with the rearward extremity of said shank to facilitate manipulation of the probe device, and equipped with electrical contacts interactive with each electrical conductor, b) electronic monitoring and display means interactive with said electrical conductors by way of said terminals and serving to indicate an individual conductor and its distance from the upper edge surface of said shank, said distance corresponding to the travel distance of a slideable member touching the corresponding electrical contact, c) a source of low voltage direct current adapted to flow through said lock, shank and electronic monitoring and display means, and d) correlation means for associating the indicated travel distance with a particular slideable member.

In employing the system of this invention, the probe is fully inserted into the key-receiving slot, then slowly withdrawn. As the probe is being withdrawn, the vertical travel distance for each slideable member is measured as the lowermost or bearing surface of the member slides down the ramp to its greatest depth, as sensed by the conductors. Said depth is read by said electronic monitoring and display means and correlated with the axial distance of insertion of said shank or the numerical sequence of a particular slideable member.

In a preferred embodiment, the probe includes an auxiliary shank which insertively engages the lower border surface of the key receiving slot, and provides an upper bearing surface for sliding support of the lower edge surface of said shank.

BRIEF DESCRIPTION OF THE DRAWING

For a fuller understanding of the nature and objects of the invention, reference should be had to the following detailed description taken in connection with the accompanying drawing forming a part of this specification and in which similar numerals of reference indicate corresponding parts in all the figures of the drawing.

DESCRIPTION OF THE PREFERRED EMBODIMENT

Figure 1:
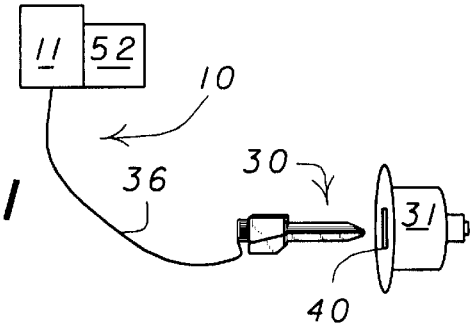
FIG. 1 is a schematic view of an embodiment of the lock decoding system of the present invention.
Figure 2:
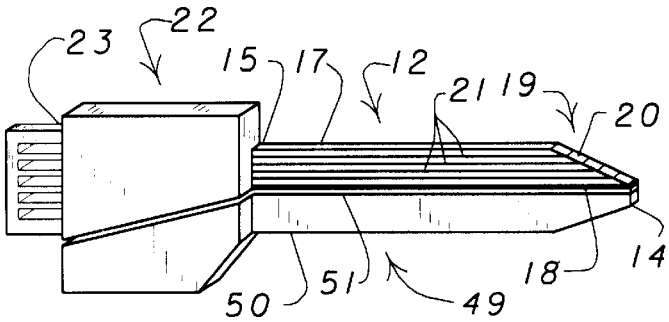
FIG. 2 is an enlarged perspective side view of the probe device of the system of FIG. 1.
Figure 4:
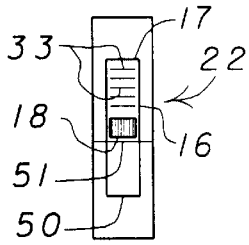
FIG. 4 is a further enlarged view of the probe device of FIG. 2, taken from the right of FIG. 2.
Figure 3:
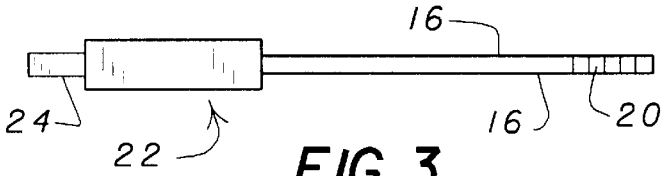
FIG. 3 is a top view of the probe device of FIG. 2.
Figure 5:
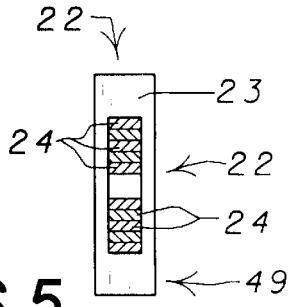
FIG. 5 is an enlarged end view of the probe device of FIG. 2, taken from the left of FIG. 2.
Figure 6:
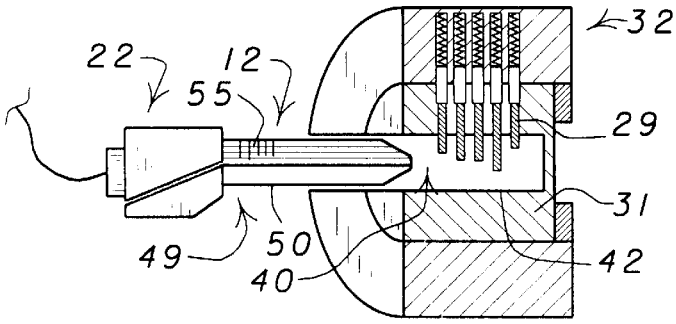
FIG. 6 is a sectional perspective view showing the operation of the probe device of the present invention with a tumbler lock of conventional prior art design.
Figure 7:
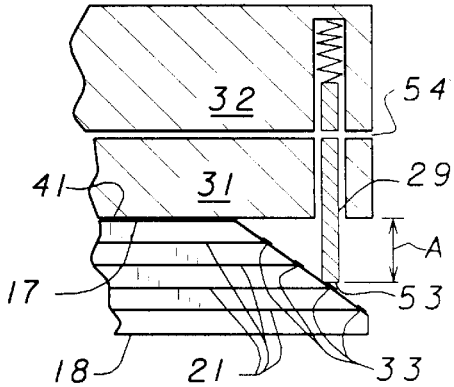
FIG. 7 is an enlarged fragmentary schematic side view illustrating the operation of the system of this invention on a tumbler lock.

Referring now to FIGS. 1–7, an embodiment of the lock decoding system 10 of the present invention is shown comprised of probe device 30 electrically interconnected to electronic monitor and display unit 11.

Probe device 30 has the general size and contour of a key expected to fit within a key receiving slot or keyway 40 of cylindrical plug 31 of a conventional tumbler lock 32, said keyway bounded by straight upper and lower border surfaces 41 and 42, respectively. Probe device 30 is comprised in part of a straight shank 12 elongated between forward and rearward extremities 14 and 15, respectively. Shank 12 is bounded by opposed flat side surfaces 16 and straight parallel upper and lower edge surfaces 17 and 18, respectively. A tip portion 19 of said shank is defined by straight oblique ramp surface 20 extending forwardly from upper edge surface 17 and convergently toward said lower edge surface 18.

Shank 12 is fabricated of rigid electrically insulative material such as moldable plastics. The length of shank 12, measured between said forward and rearward extremities, may be between about 25 and 50 millimeters. Its width, measured between said upper and lower edge surfaces, may be between about 5 and 10 millimeters, and its thickness, measured between flat side surfaces 16, may be between 1 and 2 millimeters. An auxiliary shank 49, having bottom straight edge 50 and top straight edge 51, is adapted to insert into said keyway in a manner placing said bottom straight edge in sliding abutment with the lower border surface 42 of said keyway.

A series of spaced apart straight electrical conductors 21 is embedded within shank 12 in parallel relationship to said upper and lower edge surfaces 17 and 18, respectively. Said conductors may be wires, ribbons or equivalent conductive pathways. Conductors 21 will range in number from 8 to 20, and are spaced apart by 0.5 to 1.0 millimeters. The conductors are electrically insulated from one another, and preferably insulated with respect to contact with side surfaces 16. Said conductors terminate in said ramp surface, where they form active electrical contacts 33 capable of interacting with the lowermost or bearing surfaces 53 of slideable members such as tumbler pins 29 or wafers of a lock to complete an electrical circuit.

A head portion 22, attached to the rearward extremity of said shank, facilitates the manipulation of the probe device. The back extremity 23 of said head portion contains electrical terminals 24 corresponding to each electrical conductor.

Said electronic display means is interactive with electrical conductors 21 by way of terminals 24, to indicate an individual conductor and its distance from upper edge surface 17. Said distance, denoted as A in FIG. 7, corresponds to the requisite travel distance for that particular slideable member at a particular axial location. The travel distance A indicates the key cut required at a particular tumbler or wafer to establish an open shear line 54.

A DC battery 52 supplies a voltage through a wire 36 creating an electrical circuit through the lock housing 32, tumblers 29 or wafers, conductors 21 and electronic monitoring and display unit 11. The input from the different inputs are sorted out by the electronic monitoring and display unit 11 to produce a number for each tumbler or wafer corresponding to the travel distance or depth of key cut at that location. Suitable electronic monitoring and display means may be a programmable micro controller manufactured by Radio Shack or a computer such as Palm Pilot, manufactured by 3 Com.

In operation, auxiliary shank 50 is first inserted into the keyway of the lock. Shank 12 is then fully inserted into the keyway in a manner whereby its lower edge surface 18 slides upon the top straight edge 51 of said auxiliary shank. In this position, the several pins 29 of the lock are supported upon non-conductive upper edge surface 17.

Shank 12 is then slowly withdrawn from the keyway while the electrical circuitry of the system is active. Such action causes said pins to slide along said upper edge surface, and then down ramp surface 20. As each sequential bearing surface 53 of a slideable tumbler pin or wafer touches the lowest contact 33 on ramp surface 20, an electrical circuit is completed involving a particular conductor 21, and the travel distance for that particular slideable member is thereby determined and recorded in the electronic display means. Correlation means for associating the indicated travel distance with a particular slideable member may be in the form of a linear scale of markings 55 on side surface 16, or may be a counting protocol incorporated into said electronic monitoring means and which assigns travel distances sequentially to each slideable member. When shank 12 is fully removed from the keyway, the key cut code for the particular lock is ascertained, recorded and displayed. It has been found that the use of auxiliary shank 50 permits more accurately controlled movement of shank 12.

While particular examples of the present invention have been shown and described, it is apparent that changes and modifications may be made therein without departing from the invention in its broadest aspects. The aim of the appended claims, therefore, is to cover all such changes and modifications as fall within the true spirit and scope of the invention.

Having thus described my invention, what is claimed is:

1. A system for decoding tumbler locks and wafer locks having a rotatably mounted cylindrical plug having an elongated key receiving slot interactive with a series of slideable members spring urged orthogonally toward said slot and having different travel distances relative to flush fit with the surface of said plug, said flush fit establishing a shear line which permits rotation of the plug, said system comprising:

a) a probe device having the general contour of a key expected to fit within said key receiving slot and having:

1) a straight shank fabricated of electrically insulative material and elongated between forward and rearward extremities and bounded by opposed flat side surfaces and straight parallel upper and lower edge surfaces, and terminating in a tip portion having an oblique ramp surface extending forwardly from said upper edge surface and convergent toward said lower edge surface, said ramp surface configured to sequentially contact said slideable members, 2) a series of spaced apart electrical conductors embedded within said shank in parallel relationship to said edge surfaces and forwardly terminating in electrical contacts in said ramp surface, and 3) a head portion associated with the rearward extremity of said shank to facilitate manipulation of the probe device, and equipped with electrical terminals interactive with each electrical conductor, b) electronic monitoring and display means interactive with said electrical conductors by way of said terminals and serving to indicate an individual conductor and its distance from the upper edge surface of said shank, said distance corresponding to the travel distance of a slideable member touching the corresponding electrical contact, c) a source of low voltage direct current adapted to flow through said lock, shank and electronic monitoring and display means, and d) correlation means for associating the indicated travel distance with a particular slideable member.

2. The system of claim 1 wherein said key receiving slot has upper and lower border surfaces.

3. The system of claim 2 further comprising an auxiliary shank configured to insertively engage the lower border surface of said key receiving slot.

4. The system of claim 3 wherein said auxiliary shank has an upper bearing surface configured to slideably support the lower edge surface of said straight shank.

5. The system of claim 1 wherein the length of said straight shank, measured between said forward and rearward extremities, is between 25 and 50 millimeters.

6. The system of claim 5 wherein the width of said straight shank, measured between said upper and lower edge surfaces, is between 5 and 10 millimeters.

7. The system of claim 6 wherein the thickness of said straight shank, measured between said flat side surfaces, is between 1 and 2 millimeters.

8. The system of claim 1 wherein said electrical conductors range in number from 8 to 20 and are spaced apart by 0.5 to 1.0 millimeters.

9. The system of claim 1 wherein said electrical conductors are electrically insulated from one another, and insulated with respect to said side surfaces and upper and lower edge surfaces.

10. The system of claim 1 wherein said electronic monitoring and display means is a programmable micro controller.

* * * * *